US007656254B2

(12) United States Patent
Takei et al.

(10) Patent No.: US 7,656,254 B2
(45) Date of Patent: Feb. 2, 2010

(54) DIELECTRIC FILTER HAVING ELECTRODES JUMP-COUPLED TO A FLEXION, A CHIP DEVICE HAVING THE DIELECTRIC FILTER AND METHOD OF MANUFACTURING THE CHIP DEVICE

(75) Inventors: Yasunori Takei, Yasu (JP); Motoharu Hiroshima, Gamo-gun (JP); Hideyuki Kato, Moriyama (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 4 days.

(21) Appl. No.: 12/132,885

(22) Filed: Jun. 4, 2008

(65) Prior Publication Data

US 2008/0224800 A1 Sep. 18, 2008

Related U.S. Application Data

(63) Continuation of application No. PCT/JP2007/062753, filed on Jun. 26, 2007.

(30) Foreign Application Priority Data

Sep. 28, 2006 (JP) ..... 2006-265660

(51) Int. Cl.
*H01P 3/08* (2006.01)

(52) U.S. Cl. ..... 333/204; 333/134; 333/185; 333/202

(58) Field of Classification Search ..... 333/202–206, 333/219, 134, 185
See application file for complete search history.

(56) References Cited

U.S. PATENT DOCUMENTS 5,136,269 A * 8/1992 Seitzer et al. ..... 333/204
5,298,873 A * 3/1994 Ala-Kojola ..... 333/235
5,373,271 A * 12/1994 Hirai et al. ..... 333/205

(Continued)

FOREIGN PATENT DOCUMENTS

JP 02-146801 6/1990

(Continued)

OTHER PUBLICATIONS

PCT/JP2007/062753 International Search Report dated Sep. 28, 2007.

(Continued)

*Primary Examiner*—Robert Pascal
*Assistant Examiner*—Kimberly E Glenn
(74) *Attorney, Agent, or Firm*—Dickstein Shapiro LLP

(57) ABSTRACT

A chip device having a ground electrode and a plurality of top-surface electrodes on a plate-like dielectric substrate. Two of the top-surface electrodes are connected to the ground electrode via respective short-circuit side-surface electrodes to form quarter wavelength resonant lines. A third top-surface electrode is provided between the two top-surface electrodes and both ends thereof are opened to form a half wavelength resonant line. The two top-surface electrodes each have a parallel portion arranged near and in parallel to the third top-surface electrode and a flexion that curves from the parallel portion, extends toward the remaining of the two top-surface electrodes, and is jump-coupled to the remaining of the two top-surface electrodes. The short-circuit side-surface electrodes are jump-coupled to each other, like the flexions.

12 Claims, 7 Drawing Sheets

U.S. PATENT DOCUMENTS

| | | | | |
|---|---|---|---|---|
| 5,608,364 | A * | 3/1997 | Hirai et al. | 333/204 |
| 5,896,073 | A * | 4/1999 | Miyazaki et al. | 333/204 |
| 6,535,077 | B1 * | 3/2003 | Hiroshima et al. | 333/26 |
| 6,801,101 | B2 * | 10/2004 | Hiroshima et al. | 333/134 |

FOREIGN PATENT DOCUMENTS

| | | |
|---|---|---|
| JP | 05-283907 | 10/1993 |
| JP | 10-107537 | 4/1998 |
| JP | 2000-357902 | 12/2000 |
| JP | 2001-518727 | 10/2001 |
| JP | 2001-358501 | 12/2001 |
| JP | 2002-026605 | 1/2002 |
| JP | 2004-194296 | 7/2004 |
| JP | 2006-80880 | 3/2006 |

OTHER PUBLICATIONS

PCT/JP2007/062753 Written Opinion dated Sep. 28, 2007.

* cited by examiner

DIELECTRIC FILTER HAVING ELECTRODES JUMP-COUPLED TO A FLEXION, A CHIP DEVICE HAVING THE DIELECTRIC FILTER AND METHOD OF MANUFACTURING THE CHIP DEVICE

CROSS REFERENCE TO RELATED APPLICATIONS

The present application is a continuation of International Application No. PCT/JP2007/062753, filed Jun. 26, 2007, which claims priority to Japanese Patent Application No. JP2006-265660, filed Sep. 28, 2006, the entire contents of each of these applications being incorporated herein by reference in their entirety.

FIELD OF THE INVENTION

The present invention relates to a dielectric filter having a dielectric substrate on which a plurality of resonant lines and a ground electrode are provided, a chip device provided with the dielectric filter, and a method of manufacturing the chip device.

BACKGROUND OF THE INVENTION

Multiple dielectric filters are proposed, which each have multiple resonators on a dielectric substrate and which achieve desired filter characteristics by using the coupling between the resonators.

FIG. 1 illustrates a configuration of a dielectric filter disclosed in Patent Document 1. The dielectric filter 101 is a three-stage filter using three resonators. The three resonators are composed of lines 102, 103A, and 103B, respectively, provided on the same main surface of a dielectric substrate. The line 102 has a curved U shape and both ends of the line 102 are opened. The lines 103A and 103B each have an I shape. One end of the line 103A is connected to a ground electrode 105 and the other end thereof is opened. One end of the line 103B is connected to the ground electrode 105 and the other end thereof is opened. An input-output transmission line 104A is connected to the line 103A and an input-output transmission line 104B is connected to the line 103B.

In the above configuration, the filter characteristics, particularly, the passband depends on the degree of coupling between adjacent resonators. Accordingly, the dielectric filter disclosed in the Patent Document 1 shifts the positions where the lines are arranged to adjust the opposing lengths of adjacent lines in order to set the degree of coupling.

Patent Document 2 discloses a method of manufacturing a chip device comprising a surface-mount antenna. In the manufacturing method disclosed in this document, after a circuit pattern is provided on a dielectric host substrate, chip device elements are cut out from the dielectric host substrate and electrodes are arranged on side surfaces of the chip device elements to manufacture the chip device.

Patent Document 1: Japanese Unexamined Patent Application Publication No. 2001-358501

Patent Document 2: Japanese Unexamined Patent Application Publication No. 10-107537

In the dielectric filter described in Patent Document 1, the passband can be set by adjusting the opposing lengths of adjacent lines. However, it is not possible to finely set an attenuation pole toward lower frequencies of the passband in such a dielectric filter. For example, it is difficult to realize an attenuation curve that falls sharply toward lower frequencies of the passband.

In addition, since the degree of coupling is adjusted by shifting the positions where adjacent resonant lines are arranged, it is necessary to increase the amount of shift in the arrangement position depending on the degree of coupling that is set and the area of the circuit is consequently increased. Accordingly, with the configuration of the dielectric filter disclosed in Patent Document 1, the restriction on the area of the substrate of the chip device may not be met even if a desired passband is achieved.

SUMMARY OF THE INVENTION

In order to resolve the above problems, an object of the present invention is to provide a dielectric filter capable of reducing the area of the circuit to achieve desired filter characteristics. Another object of the present invention is to provide a method of manufacturing a chip device having desired filter characteristics with the restriction on the area of the substrate met.

MEANS FOR SOLVING THE PROBLEMS

A dielectric filter according to the present invention includes a ground electrode provided on the bottom surface of a plate-like dielectric substrate, a plurality of top-surface electrodes provided on the top surface of the dielectric substrate, and an input-output terminal coupled to any resonator composed of the ground electrode and each of the top-surface electrodes. At least two top-surface electrodes each compose a quarter wavelength resonant line, one end of each of the at least two top-surface electrodes being connected to the ground electrode via a side-surface electrode provided on a side surface of the dielectric substrate and the other end of each of the at least two top-surface electrode being opened. At least one top-surface electrode composes a half wavelength resonant line, one end of the at least one top-surface electrode being opened near one quarter wavelength resonant line and the other end of the at least one top-surface electrode being opened near the other quarter wavelength resonant line. At least one of the two quarter wavelength resonant lines includes a parallel portion parallel to the half wavelength resonant line and a flexion that curves from the parallel portion, extends toward the other quarter wavelength resonant line, and is jump-coupled to the other quarter wavelength resonant line.

With the above structure, the resonator length of the resonator composed of each of the quarter wavelength resonant lines and the ground electrode (this resonator is hereinafter simply referred to a quarter wavelength resonator) can be increased by the amount corresponding to the flexion. Accordingly, the shapes (for example, the line lengths) of the parallel portion and the flexion can be adjusted to very widely set the resonator length of the quarter wavelength resonator.

In addition, the degree of coupling between the quarter wavelength resonator and the resonator composed of the half wavelength resonant line (this resonator is hereinafter simply referred to as a half wavelength resonator) can be adjusted by varying the shape of the parallel portion (for example, the distance between the parallel portion and the half wavelength resonator or the opposing lengths of the parallel portion and the half wavelength resonator).

Furthermore, the two quarter wavelength resonators can be jump-coupled to each other near their flexions. Accordingly, the shape of the flexion (for example, the distance between the flexion and the other half wavelength resonator or the opposing lengths of the flexion and the other half wavelength resonator) can be adjusted to very widely vary the amount of jump-coupling.

Furthermore, since the quarter wavelength resonant line is curved, the substrate area can be reduced. Accordingly, it is possible to reduce the area where the circuit is formed.

As described above, the various characteristics can be widely varied, so that the dielectric filter having a desired passband and a desired attenuation pole can be realized with the restriction on the circuit formation area of the dielectric filter met.

According to the present invention, the flexion is provided toward the short-circuited end on the top main surface of the dielectric substrate, and the side-surface electrode connecting the flexion to the ground electrode is jump-coupled to the side-surface electrode short-circuiting the other quarter wavelength resonant line with the ground electrode.

With the above structure, the provision of the side-surface electrodes can also increase the amount of jump-coupling. Accordingly, it is possible to very widely vary the amount of jump-coupling by adjusting the shape of the side-surface electrodes (for example, the distance between the two side-surface electrodes and the opposing lengths of the two side-surface electrodes).

According to the present invention, the half wavelength resonant line has portions parallel to the parallel portion of the quarter wavelength resonant line and portions parallel to the flexion of the quarter wavelength resonant line.

With the above structure, the degree of coupling between the half wavelength resonant line and the quarter wavelength resonant line can be increased at the portion where the half wavelength resonant line is near and in parallel to the flexion. Accordingly, the shape of the portion (for example, the distance between the portion and the flexion and the opposing lengths of the portion and the flexion) can be adjusted to very widely vary the degree of coupling. In addition, the provision of the portion increases the resonator length of the half wavelength resonator. Accordingly, the shape of the portion (for example, the line length of the portion) can be adjusted to very widely set the resonator length of the half wavelength resonator. Furthermore, since the half wavelength resonant line is curved, the substrate area can be reduced. Accordingly, it is possible to very widely set the substrate area.

According to the present invention, the flexion is provided with a coupling electrode conducting the two quarter wavelength resonant lines to each other.

With the above structure, in the resonant mode (the "odd" mode) in which the electric field distributions of the two quarter wavelength resonators are in reverse phase with each other and the electric wall exists between the two quarter wavelength resonators, the two quarter wavelength resonators resonate in a state in which the two quarter wavelength resonators are short-circuited by the coupling electrode. In contrast, in the resonant mode (the "even" mode) in which the electric field distributions of the two stripline resonators are in phase with each other and the magnetic wall exists between the two stripline resonators, the two stripline resonators resonate in a state in which the two stripline resonators are opened at the coupling electrode. Accordingly, the resonator lengths in the "odd" mode are shorter than those in the "even" mode and, therefore, the frequency in the "odd" mode is higher than that in the "even" mode. As a result, the difference in the resonant frequency between the "odd" mode and the "even" mode is increased to achieve a strong jump-coupling. Consequently, the shape of the coupling electrode (for example, the position where the coupling electrode is formed) can be adjusted to very widely set the amount of jump-coupling.

In the dielectric filter according to the present invention, the line width of the half wavelength resonant line is made larger than the line width of each of the two quarter wavelength resonant lines.

With the above structure, the conductor loss is reduced at the half wavelength resonant line comprising the central-stage resonator, among the three resonators. Accordingly, the insertion loss of the dielectric filter is made small.

A chip device according to the present invention is provided with any of the above dielectric filters as part of the circuit configuration.

The chip device satisfies both a desired substrate area and desired filter characteristics.

In the chip device according to the present invention, an insulating layer is layered on the top main surface of the dielectric substrate.

Since layering the insulating layer can prevent the side-surface electrodes from being short-circuited with the parts where connection is not necessary of the top-surface electrode, the chip device can be structured only by uniformly forming the side-surface electrodes on side surfaces of the insulating layer and the dielectric substrate in the manufacturing of the chip device. Accordingly, it is possible to simplify the manufacturing process.

A method of manufacturing the chip device according to the present invention includes a dividing step of dividing a plate-like dielectric host substrate having the plurality of top-surface electrodes on its top main surface and having the ground electrode on its bottom main surface to form a plurality of chip device elements and a side-surface electrode forming step of printing a conductive paste from the top-surface electrodes to the ground electrode on side surfaces of the chip device elements formed by the dividing step and performing drying and firing to the conductive paste to form the side-surface electrodes.

In the side-surface electrode forming step in the method of manufacturing the chip device according to the present invention, the distance between the side-surface electrodes of the two quarter wavelength resonant lines is optimized on a chip device element extracted from the plurality of chip device elements formed by the dividing step and the side-surface electrodes are spaced by the optimized distance on all of the plurality of chip device elements.

With the manufacturing method, it is possible to improve the mass productivity of the chip device satisfying both desired filter characteristics and a desired substrate area.

According to the dielectric filter and the chip device of the invention, the capacitance of jump-coupling can be adjusted to set the frequency of the attenuation pole toward lower frequencies of the passband to a desired value. The area where the electrodes are formed can be reduced. Accordingly, it is easy to satisfy both a desired substrate area and desired filter characteristics. In addition, it is possible to structure the dielectric filter having an attenuation curve that rises sharply at lower frequencies of the passband. Furthermore, with the method of manufacturing the chip device of the present invention, it is possible to adjust the filter characteristics even after the circuit pattern and/or the insulating layer or the like are formed on the top surface of the dielectric substrate, thus dramatically improve the mass productivity.

REFERENCE NUMERALS

Figure 1:
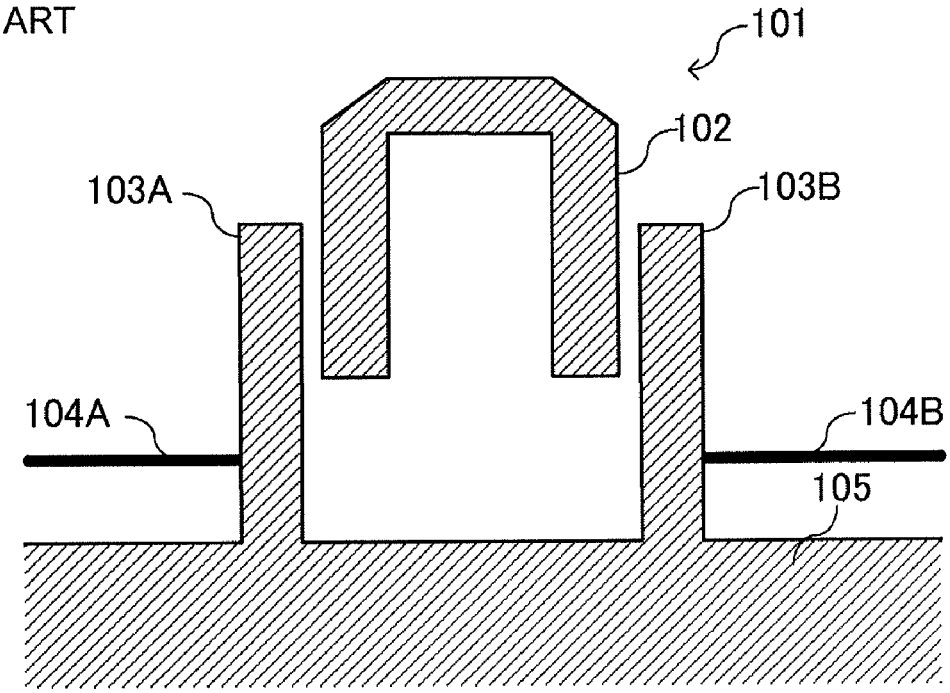
FIG. 1 PRIOR ART
FIG. 1 illustrates a configuration of a dielectric filter in related art.

1 chip device
2 glass layer
3 protrusion electrodes
10 dielectric substrate
11A, 11B short-circuit side-surface electrodes
12A, 12B tap connection extraction electrodes
13A, 13B, 14 top-surface electrodes
15 ground electrode
16A, 16B terminal electrodes
17 non-electrode portions
18 flexions
19 parallel portions
27 coupling electrode
102, 103A, 103B lines
104A, 104B input-output transmission lines
105 ground electrode

DETAILED DESCRIPTION OF THE INVENTION

A chip device according to a first embodiment of the present invention will now be described with reference to the attached drawings. A Cartesian coordinate system (X-Y-Z axes) shown in the drawings is used in the following description.

Figure 2:
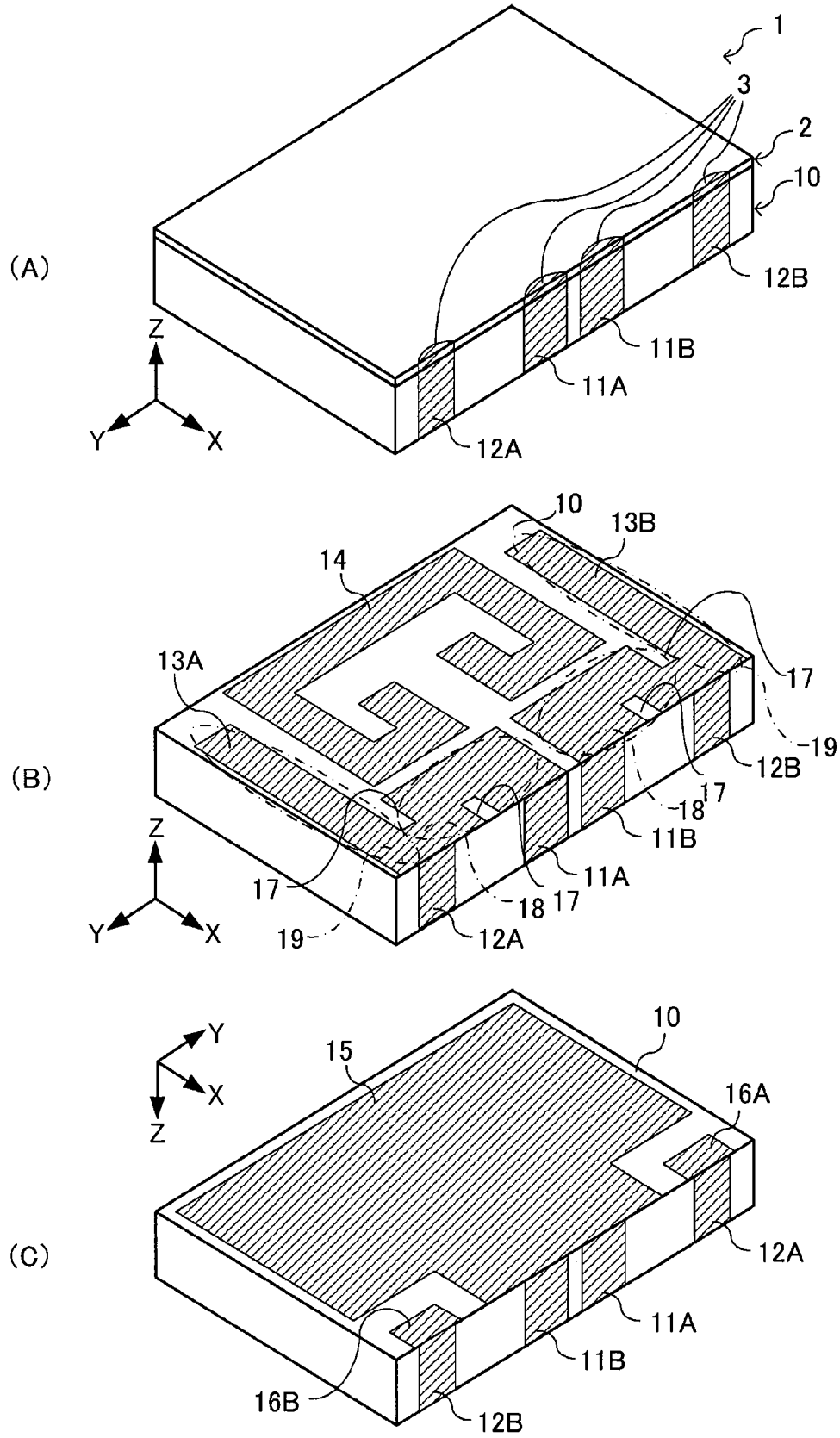
FIG. 2 includes perspective views illustrating a chip device according to a first embodiment of the present invention.

A schematic configuration of a chip device according to the present embodiment will now be described. FIG. 2(A) is a perspective view of the chip device according to the present embodiment. The top main surface (+Z surface) of the chip device faces upward, the front surface (+Y surface) thereof faces forward toward the left hand, and the right side surface (+X surface) thereof faces forward toward the right hand.

The chip device is a small rectangular parallelepiped filter device realizing filter characteristics used in electronic toll collection (ETC) communication. The chip device 1 has a rectangular plate-like dielectric substrate 10 coated with a glass layer 2 on its top main surface. The dielectric substrate 10 has a substrate thickness (Z-axis dimension) of 500 μm and the glass layer 2 has a thickness (Z-axis dimension) of 15 to 60 μm. The chip device 1 has an external dimension of about 2.0 mm along the X axis, has an external dimension of about 1.3 mm along the Y axis, and has an external dimension of about 0.56 mm along the Z axis.

The dielectric substrate 10 is composed of, for example, a titanium oxide ceramic dielectric body. The dielectric substrate 10 has a relative permittivity of about 110. The glass layer 2 is formed by screen printing of a glass paste composed of an insulator containing crystalline $SiO_2$ and borosilicate glass and firing. The glass layer 2 has a structure (not shown) including a translucent glass layer and a light-shielding glass layer layered on the translucent glass layer.

The translucent glass layer is provided so as to be in contact with the dielectric substrate 10. The translucent glass layer has a high adhesion strength to the dielectric substrate 10 to prevent the circuit pattern on the dielectric substrate 10 from peeling off in order to improve the environmental resistance of top-surface electrodes described below and the chip device 1. The light-shielding glass layer contains inorganic pigment and is layered on the translucent glass layer. The provision of the light-shielding glass layer allows printing on the surface of the chip device 1 and ensures security of the internal circuit pattern. The glass layer 2 may not necessarily have the two-layer structure. The glass layer 2 may have a single-layer structure or the glass layer 2 may not be provided. The compositions and dimensions of the dielectric substrate 10 and the glass layer 2 are appropriately set in consideration of, for example, the degree of adhesion between the dielectric substrate 10 and the glass layer 2, the environmental resistance, and the filter characteristics.

Multiple protrusion electrodes 3 are provided on the top main surface of the chip device 1, that is, on the top main surface of the glass layer 2. The protrusion electrodes 3 are protruded on the top surface in the printing of side-surface electrodes described below and are not possibly produced depending on printing conditions. The electrodes are also protruded on the bottom main surface of the chip device 1 in the printing of the side-surface electrodes. The protrusion electrodes on the bottom main surface are integrated with a ground electrode 15 and terminal electrodes 16A and 16B. Since the glass layer 2 is layered on the top main surface of the dielectric substrate 10, it is possible to prevent the protrusion electrodes from being short-circuited with parts where connection is not necessary of the top-surface electrodes in the printing of the side-surface electrodes.

FIG. 2(B) is a diagram in which the glass layer 2 is removed from the chip device 1. FIG. 2(B) is a perspective view in which the top main surface (+Z surface) of the chip device 1 faces upward, the front surface (+Y surface) thereof faces forward toward the left hand, and the right side surface (+X surface) thereof faces forward toward the right hand. FIG. 2(C) is a perspective view given by rotating the dielectric substrate 10 around the X axis by 180° from the state in FIG. 2(B). The bottom main surface (−Z surface) of the dielectric substrate 10 faces upward, the rear surface (−Y surface) thereof faces forward toward the left hand, and the right side surface (+X surface) thereof faces forward toward the right hand.

Multiple top-surface electrodes 13A, 13B, and 14 comprising stripline resonators are provided on the top main surface of the dielectric substrate 10, which is between the dielectric substrate 10 and the glass layer 2. The top-surface electrodes 13A, 13B, and 14 are silver electrodes each having an electrode thickness (Z-axis dimension) of about 6 μm. The top-surface electrodes 13A, 13B, and 14 are formed by, for example, lithography of a photosensitive silver paste.

The ground electrode 15 and the terminal electrodes 16A and 16B are provided on the bottom main surface of the dielectric substrate 10, that is, on the bottom main surface of the chip device 1. The ground electrode 15 is a ground electrode for the stripline resonators and also serves as an electrode via which the chip device 1 is mounted on a mounting board. The terminal electrodes 16A and 16B are connected to high-frequency signal input-output terminals when the chip device 1 is mounted on the mounting board. The ground electrode 15 is provided on the substantially entire bottom main surface of the dielectric substrate 10. The terminal electrodes 16A and 16B are provided near the corners bordering on the right side surface and are separated from the ground electrode 15. Each of the ground electrode 15 and the terminal electrodes 16A and 16B is formed by, for example, the screen printing of a conductive paste and the firing and has a thickness (Z-axis direction) of about 15 μm.

Short-circuit side-surface electrodes 11A and 11B and tap connection extraction electrodes 12A and 12B are provided on the right side surface of the dielectric substrate 10. The short-circuit side-surface electrodes 11A and 11B and the tap connection extraction electrodes 12A and 12B are provided not only on the right side surface of the dielectric substrate 10 but also on the side surface of the glass layer 2. The short-circuit side-surface electrodes 11A and 11B and the tap connection extraction electrodes 12A and 12B are rectangular electrodes extending in the Z-axis direction from the bottom main surface of the dielectric substrate 10 to the top main surface of the glass layer 2. Each of the short-circuit side-surface electrodes 11A and 11B and the tap connection extraction electrodes 12A and 12B is formed by the screen printing of a conductive paste and firing and is a silver electrode having a thickness (X-axis dimension) of about 15 μm. Although the line widths of the short-circuit side-surface electrodes 11A and 11B and the tap connection extraction electrodes 12A and 12B are different from those of the top-surface electrodes to which the short-circuit side-surface electrodes 11A and 11B and the tap connection extraction electrodes 12A and 12B conduct, the line widths thereof may be the same as those of the top-surface electrodes to which they conduct. Although the distance between the short-circuit side-surface electrodes 11A and 11B is the same as the distance between the top-surface electrodes to which the short-circuit side-surface electrodes 11A and 11B conduct, the distance therebetween may be different from the distance between the top-surface electrodes to which they conduct.

The top-surface electrode 13A conducts to the ground electrode 15 via the short-circuit side-surface electrode 11A, and the top-surface electrode 13B conducts to the ground electrode 15 via the short-circuit side-surface electrode 11B. The top-surface electrode 13A conducts to the terminal electrode 16A via the tap connection extraction electrode 12A, and the top-surface electrode 13B conducts to the terminal electrode 16B via the tap connection extraction electrode 12B.

The top-surface electrodes 13A, 13B, and 14 described above each have an electrode thickness of about 6 μm whereas the short-circuit side-surface electrodes 11A and 11B described above each have an electrode thickness of about 15 μm. That is, the electrode thicknesses of the short-circuit side-surface electrodes 11A and 11B are larger than those of the top-surface electrodes 13A, 13B, and 14. This is because the electrode thicknesses of the portions toward the short-circuit ends where current concentration normally occurs are made larger to disperse the current in order to reduce the conductor loss. The chip device 1 has a decreased insertion loss owing to this structure.

The top-surface electrode 13A provided on the top main surface of the dielectric substrate 10 is a substantially L-shaped electrode extending along the right side surface and the front surface. The top-surface electrode 13B provided on the top main surface of the dielectric substrate 10 is a substantially L-shaped electrode extending along the right side surface and the rear surface. The top-surface electrode 13A and the ground electrode 15 compose a quarter wavelength resonator, one end of which is opened and the other end of which is short-circuited. The top-surface electrode 13B and the ground electrode 15 compose a quarter wavelength resonator, one end of which is opened and the other end of which is short-circuited.

In the following description, the portions extending along the right side surfaces of the top-surface electrode 13A and the top-surface electrode 13B are called flexions 18. The portion extending along the front surface of the top-surface electrode 13A and the portion extending along the rear surface of the top-surface electrode 13B are called parallel portions 19. The top-surface electrode 13A and the top-surface electrode 13B are connected to the short-circuit side-surface electrodes 11A and 11B, respectively, near the ends of the flexions 18 around the center of the right side surface of the dielectric substrate 10 and conduct to the ground electrode 15 via the short-circuit side-surface electrodes 11A and 11B, respectively. The top-surface electrode 13A is connected to the tap connection extraction electrode 12A at a portion where the parallel portion 19 borders on the right side surface and conducts to the terminal electrode 16A via the tap connection extraction electrode 12A. The top-surface electrode 13B is connected to the tap connection extraction electrode 12B at a portion where the parallel portion 19 borders on the right side surface and conducts to the terminal electrode 16B via the tap connection extraction electrode 12B.

Non-electrode portions 17 extending in the X-axis direction are provided near the inner corners of the flexions 18 and the parallel portions 19 and near the centers of the sides bordering on the right side surface of the flexions 18. The provision of the non-electrode portions 17 curves the flexions 18 to increase the line lengths of the top-surface electrode 13A and the top-surface electrode 13B, thus realizing further increase of the resonator length. The non-electrode portions 17 may not be necessarily provided. If the non-electrode portions 17 are not provided in the structure according to the present embodiment, the resonator lengths of the quarter wavelength resonators can be decreased to increase the resonant frequency. Conversely, if the number of the non-electrode portions is increased, the resonator lengths of the quarter wavelength resonators can be increased to decrease the resonant frequency.

The top-surface electrode 14 is a substantially C-shaped electrode, the side of which in the +X direction is opened. The top-surface electrode 14 is composed of a portion extending along the left side surface, portions extending in the +X direction along the parallel portions 19 of the top-surface electrode 13A and the top-surface electrode 13B from both ends of the portion, portions extending inward along the flexions 18 of the top-surface electrode 13A and the top-surface electrode 13B from the ends of the portions extending in the +X direction, and portions extending in the −X direction from the ends of the portions extending inward. Accordingly, the top-surface electrode 14 and the ground electrode 15 compose a half wavelength resonator, both ends of which are opened. Since the top-surface electrode 14 is curved in the above manner, the resonator length of the half wavelength resonator can be increased within the restricted substrate area. Consequently, the line length of each portion can be adjusted to very widely set the resonator length of the half wavelength resonator.

The line widths of the resonant lines comprising the top-surface electrodes 13A, 13B, and 14 are adjusted so as to realize required frequency characteristics. In chip device 1 shown in FIGS. 2(A) to 2(C), the line width of the top-surface electrode 14 is made larger than the line widths of the top-surface electrodes 13A and 13B to reduce the conductor loss of the top-surface electrode 14. Consequently, the insertion loss of the dielectric filter can be reduced. The line widths are not restricted to the ones described above and the present invention can be embodied with other line widths.

With the top-surface electrodes 13A, 13B, and 14 formed in the above manner, the stripline resonator including the top-surface electrode 13A is tap-coupled to the terminal electrode 16A. The two stripline resonators including the top-surface electrode 13A and the top-surface electrode 14 are interdigitally coupled to each other, and the two stripline resonators including the top-surface electrode 13B and the top-surface electrode 14 are interdigitally coupled to each other. The stripline resonator including the top-surface electrode 13B is tap-coupled to the terminal electrode 16B. In the two stripline resonators including the top-surface electrode 13A and the top-surface electrode 13B, the inner end of the flexion 18 of the top-surface electrode 13A is adjacent to the inner end of the flexion 18 of the top-surface electrode 13B and the short-circuit side-surface electrode 11A is adjacent to the short-circuit side-surface electrode 11B. Accordingly, the two stripline resonators including the top-surface electrode 13A and the top-surface electrode 13B are jump-coupled to each other.

The capacitance caused by the top-surface electrode 14 that opposes the parallel portion 19 of the top-surface electrode 13A and the capacitance caused by the top-surface electrode 14 that opposes the flexion 18 of the top-surface electrode 13A determine the amount of coupling between the top-surface electrode 13A and the top-surface electrode 14. The capacitances are determined by the opposing lengths of the lines and the distances between the lines. Since the flexion 18 of the top-surface electrode 13A opposes the top-surface electrode 14 to cause a capacitance, it is possible to achieve an extremely strong coupling even if the substrate area is smaller than a predetermined value. Accordingly, the amount of coupling between the top-surface electrode 13A and the top-surface electrode 14 can be easily set to a desired value.

The capacitance caused by the top-surface electrode 14 that opposes the parallel portion 19 of the top-surface electrode 13B and the capacitance caused by the top-surface electrode 14 that opposes the flexion 18 of the top-surface electrode 13B determine the amount of coupling between the top-surface electrode 13B and the top-surface electrode 14. The capacitances are determined by the opposing lengths of the lines and the distances between the lines. Since the flexion 18 of the top-surface electrode 13B opposes the top-surface electrode 14 to cause a capacitance, it is possible to achieve an extremely strong coupling even if the substrate area is smaller than a predetermined value. Accordingly, the amount of coupling between the top-surface electrode 13B and the top-surface electrode 14 can be easily set to a desired value.

The capacitance caused by the flexion 18 of the top-surface electrode 13A opposing the flexion 18 of the top-surface electrode 13B and the capacitance caused by the short-circuit side-surface electrode 11A opposing the short-circuit side-surface electrode 11B determine the amount of jump-coupling between the top-surface electrode 13A and the top-surface electrode 13B. The capacitances are determined by the opposing lengths of the lines and the distances between the lines. Accordingly, it is possible to achieve an extremely strong coupling even if the substrate area is smaller than a predetermined value, and the amount of jump-coupling between the top-surface electrode 13A and the top-surface electrode 13B can be easily set to a desired value.

Consequently, the chip device composes a bandpass filter provided with the three-stage resonators. A strong coupling is achieved by the interdigital coupling and the attenuation pole toward lower frequencies specific to the jump-coupling is used to realize desired filter characteristics.

Effects of varying of the distance between the respective flexions 18 of the top-surface electrode 13A and the top-surface electrode 13B will now be described with reference to FIG. 3.

Figure 3:
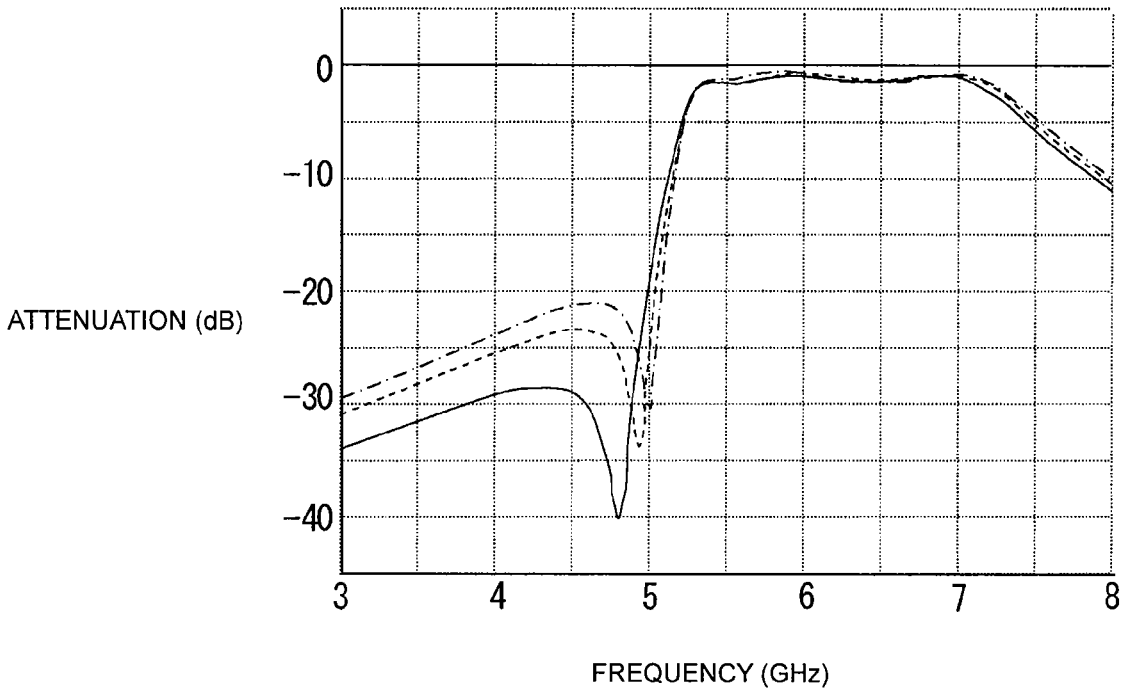
FIG. 3 is a graph showing simulation results of the chip device according to the first embodiment.

The graph shown in FIG. 3 indicates simulation results of attenuation curves when the distance between the flexions 18 of the chip device 1 is set to different values. The horizontal axis represents frequency and the vertical axis represents attenuation. A solid line in FIG. 3 represents an attenuation curve in a structure in which the distance between the flexion 18 of the top-surface electrode 13A and the flexion 18 of the top-surface electrode 13B (and the distance between the short-circuit side-surface electrode 11A and the short-circuit side-surface electrode 11B) is set to 200 μm. A broken line in FIG. 3 represents an attenuation curve in a structure in which the distance between the flexion 18 of the top-surface electrode 13A and the flexion 18 of the top-surface electrode 13B (and the distance between the short-circuit side-surface electrode 11A and the short-circuit side-surface electrode 11B) is set to 100 μm. A dotted chain line in FIG. 3 represents an attenuation curve in a structure in which the distance between the flexion 18 of the top-surface electrode 13A and the flexion 18 of the top-surface electrode 13B (and the distance between the short-circuit side-surface electrode 11A and the short-circuit side-surface electrode 11B) is set to 60 μm. Since the length of each resonator is increased with the decreasing distance and the frequency is also increased by an amount corresponding to the increased length of the resonator, the frequencies are shifted toward the lower frequencies in this simulation to align the passband with the amount of attenuation.

According to the attenuation curves with the different settings, the chip device 1 used in the simulation has a passband of about 5.6 GHz to about 7.0 GHz when the distance is varied. The chip device 1 used in the simulation has different frequencies and different amounts of attenuation at the attenuation poles toward lower frequencies of the passband for the different settings. The graph shows that the frequency of the attenuation pole is increased to approach the passband and the amount of attenuation is decreased as the distance is decreased from 200 μm to 60 μm.

As described above, decreasing the distance between the flexions allows the frequency of the attenuation pole of the filter to approach the passband. Accordingly, the attenuation pole can be set by adjusting the distance. Consequently, according to the present invention, it is possible to provide the filter device whose attenuation pole is set to a desired frequency.

The above effects can be achieved by adjusting the opposing lengths of the flexions 18 and the opposing lengths of the short-circuit side-surface electrode 11A and the short-circuit side-surface electrode 11B, instead of the distance between the flexions 18 and the distance between the short-circuit side-surface electrode 11A and the short-circuit side-surface electrode 11B. Increasing the opposing lengths even with the same distance can increase the capacitance between the flexions 18 and the capacitance between the short-circuit side-surface electrode 11A and the short-circuit side-surface electrode 11B to cause the frequency of the attenuation pole of the filter to approach the passband.

Although the distance between the flexions 18 is the same as that between the short-circuit side-surface electrode 11A and the short-circuit side-surface electrode 11B in the present embodiment and in this simulation, the distance between the flexions 18 may be different from that between the short-circuit side-surface electrode 11A and the short-circuit side-surface electrode 11B. For example, the short-circuit side-surface electrode 11A and the short-circuit side-surface electrode 11B may be spaced by a certain distance and, then, the distance may be adjusted by, for example, cutting to adjust the amount of jump-coupling.

A manufacturing process of the chip device 1 will now be described.

Figure 4:
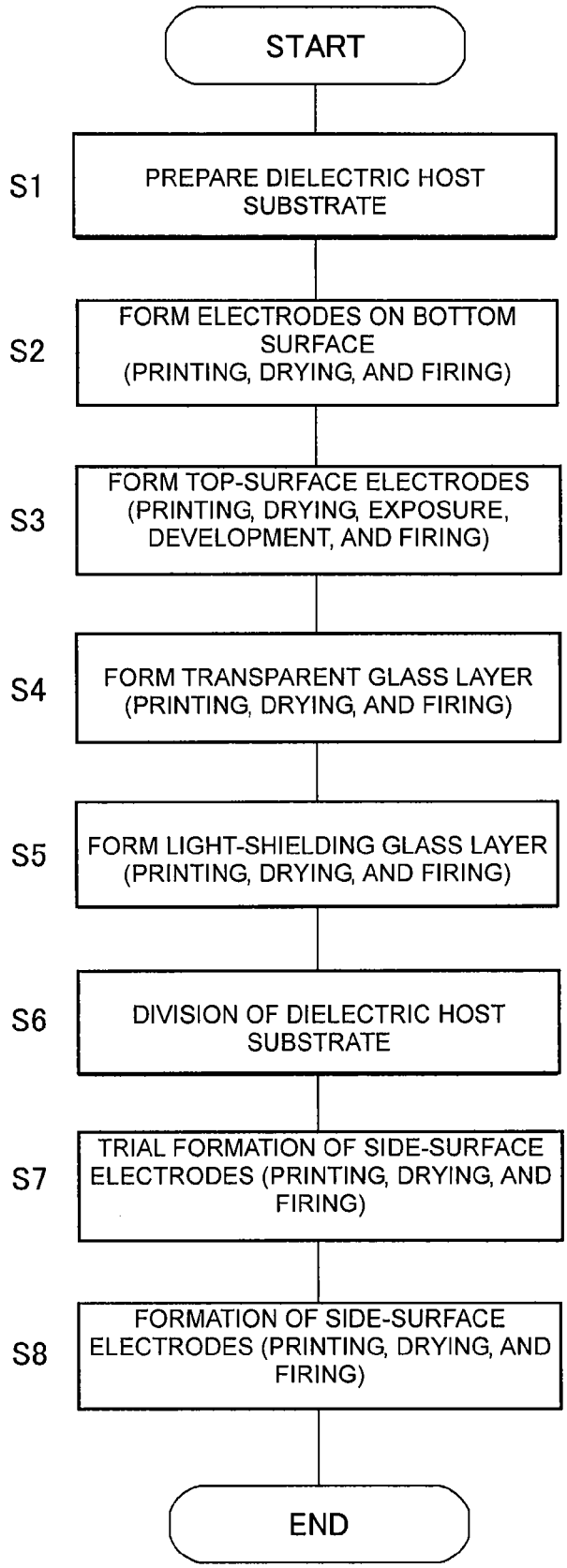
FIG. 4 is a flowchart showing a manufacturing process of the chip device according to the first embodiment.

FIG. 4 shows a manufacturing process of the chip device 1. In Step S1, a dielectric host substrate having no electrode on any surface is prepared.

In Step S2, a conductive paste is printed on the bottom main surface of the dielectric host substrate by screen printing and is subjected to drying and firing to form a ground electrode and terminal electrodes.

In Step S3, a photosensitive conductive paste is printed on the top main surface of the dielectric host substrate and is subjected to drying, exposure, development, and firing to form top-surface electrodes by photolithography.

In Step S4, a glass paste is printed on the top main surface of the dielectric host substrate and is subjected to firing to form a transparent glass layer.

In Step S5, a glass paste containing inorganic pigment is printed on the top main surface of the dielectric host substrate and is subjected to firing to form a light-shielding glass layer.

In Step S6, multiple chip device elements are cut out from the dielectric host substrate having the above structure, for example, by dicing. After the cutout, electrical characteristics of the upper surface patterns of some chip device elements are preliminarily measured.

In Step S7, one or several chip device elements are extracted from the multiple chip device elements that are cut out and trial formation of short-circuit side-surface electrodes are performed to select an optimal distance between the short-circuit side-surface electrodes, which provides desired filter characteristics.

After the distance between the short-circuit side-surface electrodes, which provides desired filter characteristics, is selected by the trial formation of the short-circuit side-surface electrodes on the extracted chip device element(s), in Step S8, a conductive paste is printed on the side surfaces of the multiple chip device elements of the same substrate lot at the optimal distance and is subjected to firing to finally form the short-circuit side-surface electrodes.

With the above manufacturing method, the short-circuit side-surface electrodes are formed on the side surface after the top-surface electrodes are formed on the top main surface to adjust the filter characteristics, so that desired filter characteristics can be reliably achieved.

Preferably, electrodes are formed on the space between the short-circuit side-surface electrodes 11A and 11B to measure filter characteristics while increasing the width of the space by, for example, cutting and the distance providing desired filter characteristics is selected in the trial formation in Step S7, and the short-circuit side-surface electrodes 11A and 11B are spaced by the selected distance in the formation in Step S8.

Figure 5:
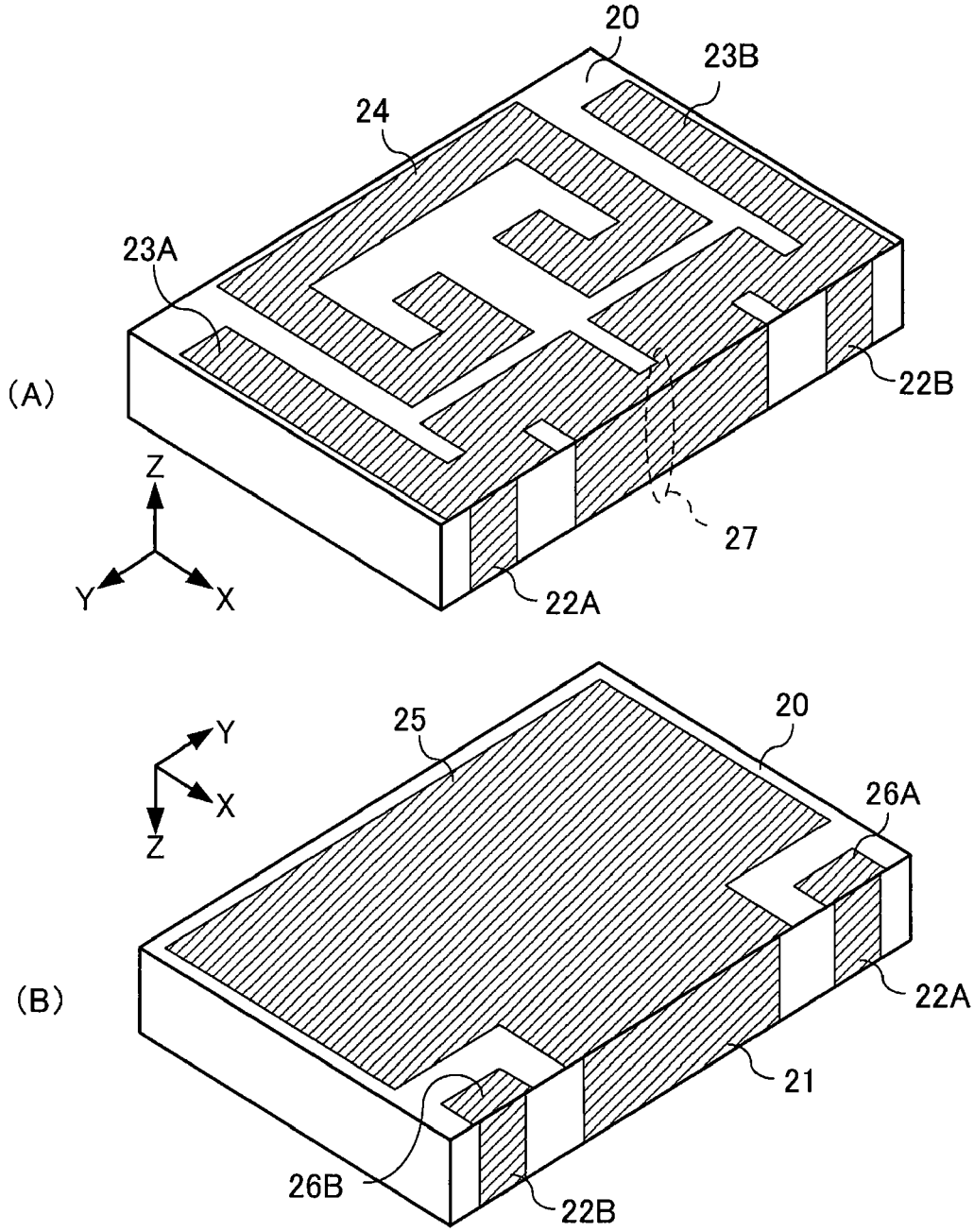
FIG. 5 includes perspective views illustrating a chip device according to a second embodiment of the present invention.

A chip device according to a second embodiment of the present invention will now be described with reference to FIGS. 5(A) and 5(B). FIG. 5(A) is a perspective view of the dielectric substrate of the chip device according to the present embodiment. The top main surface (+Z surface) of the dielectric substrate faces upward, the front surface (+Y surface) thereof faces forward toward the left hand, and the right side surface (+X surface) thereof faces forward toward the right hand. FIG. 5(B) is a perspective view given by rotating the dielectric substrate 10 around the X axis by 180° from the state in FIG. 5(B). The bottom main surface (−Z surface) of the dielectric substrate 10 faces upward, the rear surface (−Y surface) thereof faces forward toward the left hand, and the right side surface (+X surface) thereof faces forward toward the right hand.

The chip device according to the present embodiment has approximately the same structure as the chip device according to the first embodiment. The chip device according to the present embodiment differs from the chip device according to the first embodiment in that a coupling electrode 27 is provided between the respective flexions of a top-surface electrode 23A and a top-surface electrode 23B and between the short-circuit side-surface electrodes for the top-surface electrode 23A and the top-surface electrode 23. Such a structure makes the jump-coupling of the chip device of the present embodiment stronger than that of the chip device of the first embodiment.

Specifically, the two resonators composed of the top-surface electrode 23A and the top-surface electrode 23B, respectively, are coupled to each other. The resonant modes between the two resonators include an "odd" mode in which an electric wall exists between the two resonators and an "even" mode in which a magnetic wall exists between the two resonators. In the "odd" mode, the two resonators are short-circuited by the coupling electrode 27. In contrast, in the "even" mode, the two stripline resonators are opened at the coupling electrode 27. Accordingly, the lengths of the resonators in the "odd" mode are shorter than those in the "even" mode and, therefore, the frequency in the "odd" mode is higher than that in the "even" mode. Consequently, the difference in the resonant frequency between the "odd" mode and the "even" mode is increased to achieve a strong jump-coupling comparable to the interdigital coupling.

Effects of the provision of the coupling electrode 27 will now be described with reference to FIG. 6.

Figure 6:
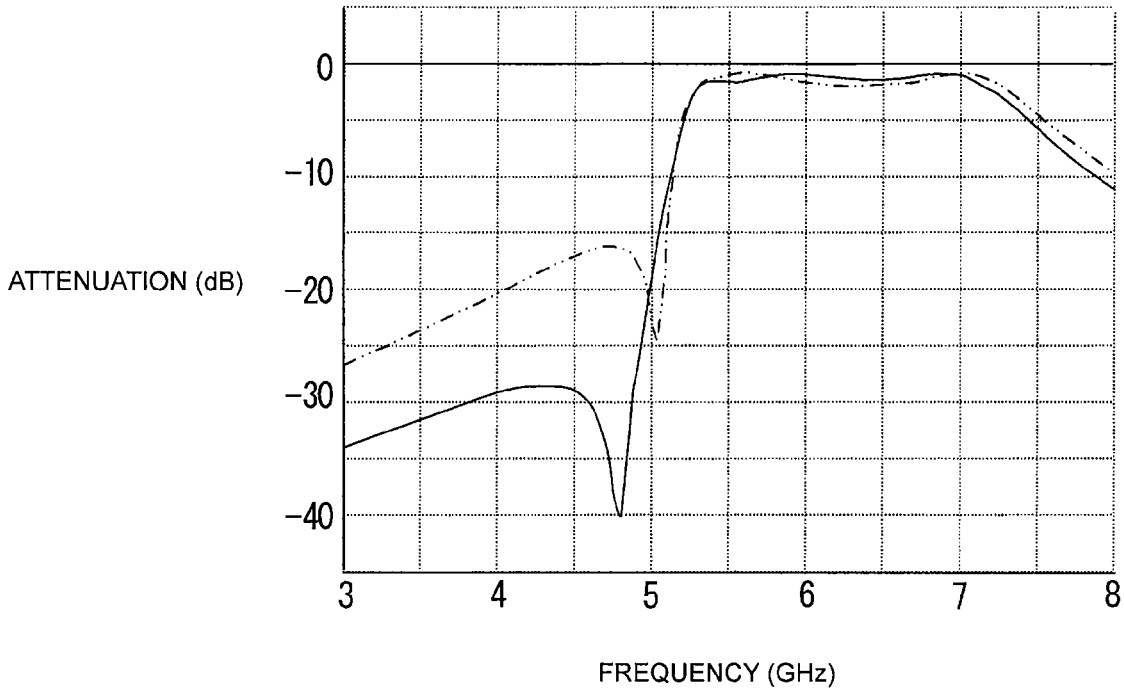
FIG. 6 is a graph showing simulation results of the chip device according to the second embodiment.

The graph shown in FIG. 6 indicates simulation results of attenuation curves of the chip device. The horizontal axis represents frequency and the vertical axis represents attenuation. A solid line in FIG. 6 represents an attenuation curve in a structure in which the distance is set to 200 μm without the coupling electrode 27. A double-dotted chain line in FIG. 6 represents an attenuation curve in a structure in which the coupling electrode 27 is provided. Since the provision of the coupling electrode 27 increases the length of each resonator and the frequency is also increased by an amount corresponding to the increased length of the resonator, the frequencies are shifted toward the lower frequencies in this simulation to align the filter characteristics.

According to the attenuation curves with the different settings, the chip device 1 used in the simulation has a passband of about 5.6 GHz to about 7.0 GHz when the distance is varied. The chip device 1 used in the simulation has different frequencies and different amounts of attenuation at the attenuation poles toward lower frequencies of the passband for the different settings. The graph shows that the provision of the coupling electrode 27 greatly increases the frequency of the attenuation pole to cause the frequency of the attenuation pole to approach the passband.

As described above, the provision of the coupling electrode 27 between the flexions can cause the frequency of the attenuation pole of the filter to approach the passband.

Figure 7:
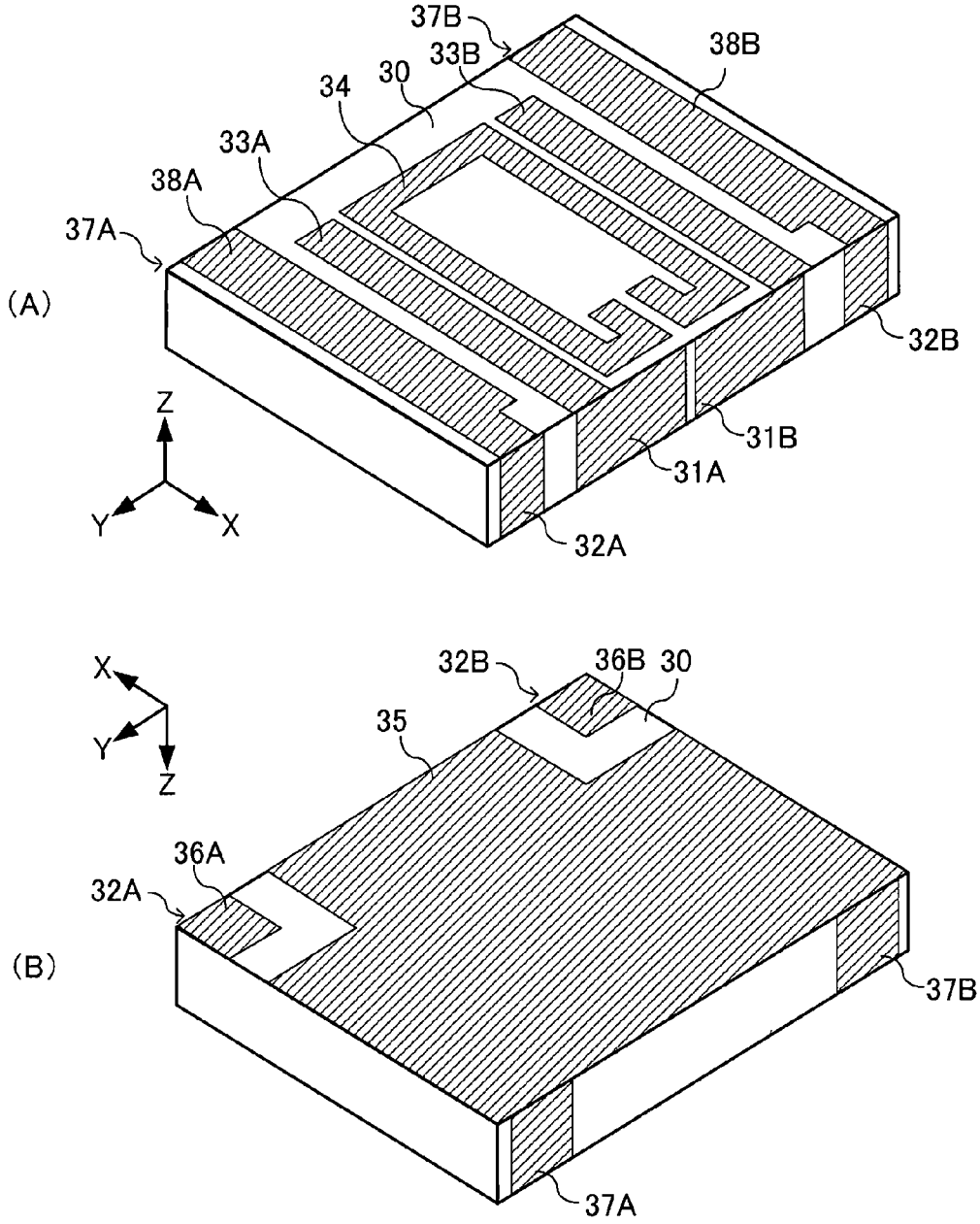
FIG. 7 includes perspective views illustrating the configuration of a chip device according to a third embodiment of the present invention.

A chip device according to a third embodiment of the present invention will now be described with reference to FIGS. 7(A) and 7(B). FIG. 7(A) is a perspective view of the dielectric substrate of the chip device according to the present embodiment. The top main surface (+Z surface) of the dielectric substrate faces upward, the front surface (+Y surface) thereof faces forward toward the left hand, and the right side surface (+X surface) thereof faces forward toward the right hand. FIG. 7(B) is a perspective view given by rotating the dielectric substrate 10 around the Y axis by 180° from the state in FIG. 7(B). The bottom main surface (−Z surface) of the dielectric substrate 10 faces upward, the front surface (+Y surface) thereof faces forward toward the left hand, and the left side surface (−X surface) thereof faces forward toward the right hand.

The chip device according to the present embodiment composes a five-state filter. The structure according to the present invention is used in the middle three filters other than the input and output stages. The present invention is applicable to a multi-stage filter having three or more states.

In an example in the present embodiment, a short-circuit side-surface electrode 31A provided toward the short-circuited end of a top-surface electrode 33A is used as the flexion of the top-surface electrode 33A and a short-circuit side-surface electrode 31B provided toward the short-circuited end of a top-surface electrode 33B is used as the flexion of the top-surface electrode 33B.

The capacitance caused by the short-circuit side-surface electrode 31A opposing the short-circuit side-surface electrode 31B determines the amount of jump-coupling between the resonator composed of the top-surface electrode 33A and the resonator composed of the top-surface electrode 33B. The capacitance is determined by the opposing lengths of the short-circuit side-surface electrodes 31A and 31B and the distance between the short-circuit side-surface electrodes 31A and 31B. Accordingly, it is possible to achieve an extremely strong coupling even if the substrate area is smaller than a predetermined value, and the amount of jump-coupling between the resonators composed of the top-surface electrode 33A and the top-surface electrode 33B can be easily set to a desired value. Consequently, the attenuation pole toward lower frequencies specific to the jump-coupling is used to realize desired filter characteristics.

The arrangements of the top-surface electrodes and the short-circuit side-surface electrodes in the above embodiments depend on the product specifications, and the top-surface electrodes and the short-circuit side-surface electrodes may have any shape as long as the product specifications are met. The number of stages of the stripline resonators is not restricted to the ones described above. The present invention is applicable to structures other than the above structures and can be adopted in various circuit patterns. Various components other than the dielectric filter may be arranged in the chip device.

The invention claimed is:

1. A dielectric filter comprising:

a dielectric substrate having a first surface and a second surface;

a ground electrode provided on the first surface of the dielectric substrate;

a plurality of electrodes provided on the second surface of the dielectric substrate; and an input-output terminal coupled to a resonator formed by the ground electrode and any one of the plurality of electrodes, wherein at least two electrodes of the plurality of electrodes each comprise a quarter wavelength resonant line, a first end of each of the at least two electrodes connected to the ground electrode via a respective side-surface electrode provided on a side surface of the dielectric substrate and a second end of each of the at least two electrode being open, wherein at least a third electrode of the plurality of electrodes comprises a half wavelength resonant line, a first end of the third electrode being opened near a first of the quarter wavelength resonant lines and a second end of the third electrode being opened near a second of the quarter wavelength resonant lines, and wherein at least one of the first and second quarter wavelength resonant lines includes a parallel portion parallel to the half wavelength resonant line and a flexion that is jump-coupled to the other of the first and second quarter wavelength resonant lines.

2. The dielectric filter according to claim 1, wherein the flexion curves from the parallel portion, extends toward the other of the first and second quarter wavelength resonant line.

3. The dielectric filter according to claim 1, wherein a thickness of the side surface electrode is larger than a thickness of the plurality of electrodes.

4. The dielectric filter according to claim 1, wherein the flexion is provided proximal to the first end of the at least one of the first and second quarter wavelength resonant lines.

5. The dielectric filter according to claim 4, wherein the side-surface electrode connects the flexion to the ground electrode and is jump-coupled to the side-surface electrode short-circuiting the other of the first and second quarter wavelength resonant lines to the ground electrode.

6. The dielectric filter according to claim 1, wherein the half wavelength resonant line has a first portion parallel to the parallel portion of the at least one of the first and second quarter wavelength resonant lines and a second portion parallel to the flexion of the at least one of the first and second quarter wavelength resonant lines.

7. The dielectric filter according to claim 1, wherein the flexion is provided with a coupling electrode connecting the two quarter wavelength resonant lines to each other.

8. The dielectric filter according to claim 1, wherein a line width of the half wavelength resonant line is larger than a line width of each of the two quarter wavelength resonant lines.

9. A chip device comprising:

a circuit configuration having the dielectric filter according to claim 1.

10. The chip device according to claim 9, wherein an insulating layer is layered on the second surface of the dielectric substrate.

11. A method of manufacturing the chip device according to claim 9, the method comprising: dividing a dielectric host substrate having the plurality of electrodes on a second surface thereof and having a ground electrode pattern on a first surface thereof to form a plurality of chip device elements; and printing a conductive paste on side surfaces of the chip device elements, and drying and firing the conductive paste to form the side-surface electrodes.

12. The method of manufacturing the chip device according to claim 11, wherein a distance between the side-surface electrodes of the two quarter wavelength resonant lines is optimized on a chip device element extracted from the plurality of chip device elements, and the side-surface electrodes are spaced apart by the distance on the remaining plurality of chip device elements.

* * * * *